United States Patent [19]

Phillips

[11] 4,391,670

[45] Jul. 5, 1983

[54] LOW ENERGY TMP FURNISH OF IMPROVED STRENGTH BY OZONATION AND PRESS DRYING

[75] Inventor: Richard B. Phillips, Tuxedo Park, N.Y.

[73] Assignee: International Paper Company, New York, N.Y.

[21] Appl. No.: 309,295

[22] Filed: Oct. 7, 1981

[51] Int. Cl.[3] ..... D21F 11/02

[52] U.S. Cl. ..... 162/12; 162/13; 162/65; 162/150; 162/71; 162/175; 162/206

[58] Field of Search ..... 162/12, 13, 28, 65, 162/142, 71, 149, 175, 206, 150

[56] References Cited

U.S. PATENT DOCUMENTS

| | | | |
|---|---|---|---|
| 3,319,352 | 5/1967 | Haigh | 34/123 |
| 4,011,034 | 3/1977 | Curry et al. | 425/80 |
| 4,040,899 | 8/1977 | Emerson | 162/13 |
| 4,080,249 | 3/1978 | Kempf et al. | 162/57 |
| 4,120,747 | 10/1978 | Sarge et al. | 162/117 |
| 4,123,317 | 10/1978 | Fritzvold et al. | 162/17 |
| 4,145,246 | 3/1979 | Goheen | 162/28 |
| 4,196,043 | 4/1980 | Singh | 162/30 |
| 4,216,054 | 8/1980 | Bentvelzen et al. | 162/57 |

OTHER PUBLICATIONS

Soteland et al., Norsk Skogindustri, 6/74, pp. 165–169.

Effect of Ozone on High-Temperature Thermomechanical Pulp, Allison, Jan. 1979, p. 279, Appita, vol. 32.

An Overview of Press Drying, Setterholm, Forest Products Laboratory, Forest Service, Tappi, Mar. 1979, vol. 62, No. 3, pp. 45–46.

The Effect of Single Nip Press Drying on Properties of Liner of High Yield Kraft Pulp, Pulp & Paper Canada, Anderson and Back, vol. 77, No. 12, 12/76.

Z-Direction Restraint, A New Approach to Papermaking, USDA Forest Service, Research Paper, FPL 256, 1975.

An Investigation of the Effects of High Press Wet Pressing on the Physical Properties of Dry Pulp Sheets, Pease and Rankin, vol. 15, No. 7, 7/62, Tappi.

Press Drying of High-Yield Hardwood Pulp, (Preliminary Report), Setterholm and Benson, Oct. 1976.

Variables in Press Drying Pulps from Sweetgum and Red Oak, Setterholm and Benson, USDA Forest Service Research Paper FPL 295, 1977.

Multistage Press Drying of Paper, Back and Anderson, Swedish Forest Products Research Laboratory, Stockholm, Svensk Papperstidning No. 2-1979 82 (1979) 35–39.

*Primary Examiner*—William F. Smith

*Attorney, Agent, or Firm*—Royal E. Bright; W. T. Zielinski

[57] ABSTRACT

Press dried paper sheets from certain ozonated high yield pulps are disclosed. Such sheets show substantially improved strength over comparable sheets prepared from non-ozonated pulps and over non-press dried sheets from ozonated pulps.

11 Claims, No Drawings

LOW ENERGY TMP FURNISH OF IMPROVED STRENGTH BY OZONATION AND PRESS DRYING

BACKGROUND OF THE INVENTION

This invention relates to paper, more specifically paper prepared from ozonated high yield pulp furnishes employing press drying techniques and to the processes for preparing said paper and to processes for its use.

Formation of paper sheets from high yield pulps such as thermomechanical pulp (TMP) high temperature mechanical (Asplund) pulp and semichemical mechanical pulp (SCMP) by various techniques including press drying is known. Because of the techniques employed in their manufacture, it has always been considered that sheets of paper prepared from TMP and Asplund pulps will be inferior in strength properties to sheets of similar basis weights prepared from chemical pulps, particularly those prepared from kraft pulps. In addition TMP requires a comparatively high input of refining energy into its preparation.

CITATION OF RELEVANT LITERATURE

Allison in Appita, Vol. 32, page 279 (1979) discloses that softwood (pine) Asplund pulp may be treated with ozone, beaten and then formed in conventional fashion to produce sheets having improved strength over sheets made from non-ozone treated pulp. The process described is substantially different from that of the invention in that a beating or refining step after ozonation is taught as required and press drying of the sheet is neither taught nor suggested.

U.S. Pat. No. 4,120,747 describes the use of ozone treated chemi-thermomechanical pulp in the manufacture of high bulk tissue. Obviously, strength in such products, beyond a minimum value, is a secondary consideration. Enhanced dry strength properties are reported for lower bulk densities. By the very nature of the tissue manufacture process this patent teaches nothing about what effects press drying of the sheet would provide.

U.S. Pat. Nos. 4,080,249; 4,123,317; 4,196,043; and 4,216,054 all are illustrative of the fact that ozone bleaching of lignocellulosic pulp is known. The use of such pulps in a furnish to be subjected to a dynamic press drying step to provide an enhanced strength paper sheet is nowhere taught or suggested.

The present invention provides a means of utilizing high yield pulp furnishes including substantial quantities of high yield, low energy pulps to provide paper sheets having strength properties approaching those of paper sheets manufactured from furnishes containing substantial percentages of chemical pulps.

SUMMARY OF THE INVENTION

The invention provides a process for the preparation of paper from thermomechanical, high temperature mechanical, and semichemical mechanical pulps comprising:

(a) treating mechanical pulp selected from thermomechanical, high temperature mechanical, semi-chemical mechanical, or mixtures thereof with ozone;

(b) forming a sheet having from about 30% to about 60% consistency from the ozone treated pulp of step a above; and (c) drying the sheet formed in step b above at high temperatures and pressure until at least about 10% to about 15% moisture content is attained.

The invention also provides an article of manufacture comprising a paper sheet produced by the process aspect of the invention.

The tangible embodiments of the composition aspect of the invention possess the inherent physical properties of being sheets of paper having colors ranging from off-white to dark brown, of possessing physical strength properties substantially similar to paper sheets having comparable basis weights manufactured from furnishes comprising substantial portions of chemical, particularly kraft pulp. The tangible embodiments of the composition aspect of the invention, thus, possess the inherent applied use characteristic of being suitable starting material for the manufacture of packaging materials such as paper bags and sacks as well as folding cartons and as linerboard for the manufacture of corrugated board and cartons.

Special mention is made of process and composition aspects of the invention wherein the pulp furnish of the process comprises mixtures of southern pine thermomechanical pulp and southern hardwood high temperature mechanical pulp. Special mention is also made of composition aspects of the invention wherein the tangible embodiments thereof additionally contain an effective amount of cationic starch.

DESCRIPTION OF THE PREFERRED EMBODIMENTS

The manner of practicing the process aspect of the invention to produce tangible embodiments of the composition aspect thereof will now be illustrated with respect to a process employing a mixture of southern pine thermomechanical pulp and southern hardwood high temperature mechanical pulp as a furnish.

Thermomechanical pulp prepared from southern pine and Asplund pulp prepared from mixed southern hardwoods may be mixed without preliminary screening at about 4% consistency at elevated temperatures conveniently about 85° to 90° C., for a short period of time until well mixed, conveniently about 30 to 45 minutes. The pulp may then be treated in standard fashion with an ozone/oxygen gas mixture, conveniently containing ozone to provide about 5% ozone consumption. Following the ozone treatment, the pulp may be formed into a paper sheet employing standard techniques. Following formation and drainage by standard techniques to about 50% consistency the sheet may then be subjected to standard press drying techniques, either static or dynamic, to provide a sheet with 10% or less average moisture content.

The dry sheets so formed may then be employed in the manufacture of packaging materials, such as corrugated paperboard.

One skilled in the art will recognize that in addition to the southern pine thermomechanical pulp illustrated herein above for the practice of the invention, other southern softwoods may also be employed as full equivalents therein. The furnishes of such softwood pulps may be of single species or of mixtures. Similarly, the Asplund hardwood pulp furnishes may be of single species or of mixtures.

The relative proportions of the softwood TMP and the hardwood Asplund pulp may also vary within wide limits with between 60% softwood/40% hardwood and 40% softwood/60% hardwood, all by weight, being preferred. Similarly, the press drying process employed may be performed by any of the techniques known in the art either static or dynamic, and the temperature, pressures and times of pressing may vary widely within the known operative limits of those processes. The exact treatment conditions may easily be determined by the operator to produce board having any desired properties in the final product within the limits possible from a particular pulp furnish.

Similarly, the amount of ozone consumed by the pulp mixture may be permitted to vary within wide limits. Consumption may vary from about 2.5% to about 10% by weight with about 5.0% by weight being preferred.

The effective amount of cationic starch may also vary within wide limits. From about 1.0% to about 15%, preferably 1.0% to 5.0% all by weight may be employed.

The following examples further illustrate the best mode contemplated by the inventor for the practice of his invention.

TABLE 1-1

| | Pulp | | | | | |
|---|---|---|---|---|---|---|
| | A | | B | | C | D |
| | Starch Addn | | | | | |
| Properties | − | + | − | + | − | − |
| Mullen (psi) | 91 | 100 | 89 | 98 | 80 | 42 |
| Tensile (lb/in) | 57 | 63 | 54 | 59 | 51 | 30 |
| Modulus of Elasticity $\times 10^{10}$ (dynes/cm$^2$) | 2.0 | — | 2.0 | 2.0 | 1.8 | 1.7 |
| Ring Crush (lb) | 113 | 117 | 105 | 116 | 122 | — |

EXAMPLE 2

Press dried sheets of 5% ozonated (Z) and non-ozonated southern pine TMP (A); southern pine Asplund pulp (E), southern hardwood TMP (F) and southern hardwood Asplund pulp (G) are prepared and their physical properties determined. Results are tabulated in Table 2-1.

TABLE 2-1

| | PULP* | | | | | | | | | | | | | | | |
|---|---|---|---|---|---|---|---|---|---|---|---|---|---|---|---|---|
| | A | | ZA | | E | | ZE | | F | | ZF | | G | | ZG | |
| MULLEN (psi) | 43 | (15) | 80–85 | (42) | 22 | (3) | 70 | (22) | 11 | (1) | 38 | (14) | 29 | (1) | 66 | (27) |
| TENSILE (lb/in) | 33 | (10) | 53 | (26) | 19 | (1.6) | 45 | (17) | 14 | (1.4) | 34 | (13) | 26 | (2.8) | 48 | (23) |
| TEAR (gm) | 220 | (175) | 270 | (326) | 211 | (53) | 309 | (256) | 63 | (31) | 168 | (122) | 110 | (39) | 167 | (117) |
| E. MODULUS $\times 10^{10}$ (dyne/cm$^2$) | 1.64 | (0.2) | 2.1 | (0.64) | 1.3 | | 2.2 | | 1.0 | | 1.6 | (0.4) | 1.4 | | 2.2 | (0.7) |
| RING CRUSH (lb) | | | 117 | | | | 101 | | | | 107 | | | | 121 | |
| STIFFNESS | 28 | | 53 | | 31 | | 48 | | 26 | | 39 | | 29 | | 42 | |

Figures in parentheses from sheets dried per TAPPI conditions.

EXAMPLE 1

Prepare TMP of 600 to 700 Canadian Standard Freeness (CSF) from southern pine chips and Asplund pulp of about the same CSF from southern hardwood chips. In the TMP preparation pre-steam at 30 psig. (approx. 127° C.) and in the Asplund preparation pre-steam at 100 psig. (approx. 166° C.). After refining requiring about 30 horsepowerdays (hpd) per air dry ton (ADT) of pulp for TMP and about 13 hpd/ADT for Asplund pulp, blend 60 g of the TMP and 40 g of the Asplund pulp and treat with water at 85° C. at 40% consistency, pH 5.5 for 20 minutes. Centrifuge and fluff the pulp so treated to about 40% consistency, treat with oxygen gas containing ozone at about 40° C. providing for about 5% by weight ozone consumption, then form a sheet from the ozonated pulp in standard fashion. After dewatering of the sheet to about 40% to 50% consistency, press dry at 300° F., 300 psi for 15 seconds to 10% or under moisture.

Properties of the sheet of this example (B) are tabulated in Table 1-1 for comparison with properties press dried sheets from ozonated southern pine thermomechanical pulp (A); ozonated 40% southern pine TMP, 60% southern hardwood Asplundh pulp (C); and non-ozonated 60% southern pine TMP, 40% southern hardwood Asplundh pulp (D). Also included are properties of sheets of A and B formed with the inclusion of 1.0% cationic starch in the furnish at the wet end during sheet formation.

The subject matter which applicants regard as their invention is particularly pointed out and distinctly claimed as follows:

1. A process for the preparation of linerboard from thermomechanical, high temperature mechanical and semichemical mechanical pulps comprising:
   (a) treating mechanical pulp selected from thermomechanical, semi-chemical mechanical, high temperature mechanical, or mixtures thereof with ozone;
   (b) forming a sheet having from about 30% to about 60% consistency from the ozone treated pulp of step a above; and
   (c) press drying the sheet formed in step b above at high temperatures and pressure until at least about 10% to about 15% moisture content is attained.

2. A process as defined in claim 1 wherein the mechanical pulp is a mixture of thermomechanical pulp and high temperature mechanical pulp.

3. A process as defined in claim 2 wherein the thermomechanical pulp comprises southern softwood thermomechanical pulp and the high temperature mechanical pulp comprises southern hardwood high temperature mechanical pulp.

4. A process as defined in claims 1, 2, or 3 wherein the mechanical pulp comprises from about 40% to about 60% by weight southern softwood thermomechanical pulp.

5. A process as defined in claims 1, 2, or 3 wherein the mechanical pulp comprises from about 40% to about 60% by weight southern hardwood high temperature mechanical pulp.

6. A process as defined in claim 1 wherein the mechanical pulp comprises 60% by weight southern softwood thermomechanical pulp and 40% by weight southern hardwood high temperature mechanical pulp.

7. A process as defined in claim 1 wherein ozone consumption by the mechanical pulp is about 2.5% to 10% by weight.

8. A process as defined in claim 1 wherein cationic starch is added to the sheet formed in step b.

9. A process as defined in claim 8 wherein about 0.5% to 5% by weight cationic starch is added at the wet end during sheet formation.

10. A process as defined in claim 7 wherein ozone consumption is about 5% by weight.

11. A process as defined in claim 9 wherein about 1.0% cationic starch is added.

* * * * *

UNITED STATES PATENT AND TRADEMARK OFFICE

CERTIFICATE OF CORRECTION

PATENT NO. : 4,391,670

DATED : July 5, 1983

INVENTOR(S) : Richard B. Phillips and Shyam S. Bhattacharjee

It is certified that error appears in the above-identified patent and that said Letters Patent are hereby corrected as shown below:

On the title page, first column:

Add the name of the coinventor, Shyam S. Bhattacharjee of Monroe, New York.

Signed and Sealed this

*Twenty-fifth* Day of *October 1983*

[SEAL]

*Attest:*

GERALD J. MOSSINGHOFF

*Attesting Officer*

*Commissioner of Patents and Trademarks*